United States Patent [19]

Cooney

[11] Patent Number: 4,612,703

[45] Date of Patent: Sep. 23, 1986

[54] PRODUCTION OF METAL-PLATED AREAS ON SELECTED INTERIOR PORTIONS OF DEEP-DRAWN TUBULAR PARTS

[75] Inventor: James S. Cooney, Attleboro, Mass.

[73] Assignee: Pylon Company, Inc., Attleboro Falls, Mass.

[21] Appl. No.: 712,615

[22] Filed: Mar. 18, 1985

[51] Int. Cl.[4] ..... H01R 43/00

[52] U.S. Cl. ..... 29/885; 72/47; 204/15

[58] Field of Search ..... 29/885; 72/47; 204/15; 148/127; 339/108 TP, 255 R

[56] References Cited

U.S. PATENT DOCUMENTS

| | | | |
|---|---|---|---|
| 2,206,662 | 7/1940 | Conradi et al. | 29/885 |
| 3,435,168 | 3/1969 | Cooney . | |
| 3,747,210 | 7/1973 | Kroll | 29/885 X |
| 4,351,174 | 9/1982 | Bauer et al. . | |
| 4,397,519 | 8/1983 | Cooney . | |
| 4,403,411 | 9/1983 | Patton | 204/15 X |
| 4,521,257 | 6/1985 | Gevatter et al. | 204/15 X |

*Primary Examiner*—Howard N. Goldberg
*Assistant Examiner*—Carl J. Arbes
*Attorney, Agent, or Firm*—Weingarten, Schurgin, Gagnebin & Hayes

[57] ABSTRACT

A method is disclosed for producing a small-diameter metal tube having a coating of a different metal on selected portions of its inner surface, the tube being used for the body of a plunger-type electrical contact. A flat piece of metal from which the tube is to be made is coated with a predetermined pattern of a second metal on at least one preselected portion of its surface, then the flat piece is subjected to deep drawing operations to produce a tube coated with a predetermined pattern of the second metal on preselected portions of its interior surface.

6 Claims, 8 Drawing Figures

PRODUCTION OF METAL-PLATED AREAS ON SELECTED INTERIOR PORTIONS OF DEEP-DRAWN TUBULAR PARTS

FIELD OF THE INVENTION

This invention relates to providing metal plating on selected areas of small diameter tubes used as bodies for plunger-type electrical contacts, and in particular, it involves a method for providing a plating of metal in selected patterns and on selected areas of the inside of such small-diameter tubes by deep drawing suitably-plated flat metal precursors.

BACKGROUND OF THE INVENTION

Plunger-type electrical contacts are known in which a tubular bore lined with conductive metal has within it a spring-loaded conductive plunger, one end of which is held within the bore and makes contact with the conductive metal liner, the other end of the plunger protruding from the end of the tubular bore and being biased outwardly to make contact with an electrical circuit. Contacts of this sort are disclosed in U.S. Pat. No. 3,435,168, which is hereby incorporated into this specification by reference. In operation, such contacts have electrical leads connected to the metal body.

The metal body of such a commercially available plunger-type contact has a tubular bore only slightly larger than the diameter of the plunger contact, which can be as small as 0.02 inches.

Several methods of producing a plating of conductive metal, usually gold, on the inside of a small tube are discussed in U.S. Pat. No. 3,435,168 at column 5, lines 8–52. Electroplating is discussed in column 5, lines 37–43, but it is there stated that it is very difficult to electroplate uniformly at selected positions within the bores of contact tubes of such small diameters. The problem is the difficulty of applying and removing resists. All the methods discussed in the U.S. Pat. No. 5,435,168 for plating the inside of a small diameter metal tube with a conductive metal produce tubes the interior surfaces of which are totally plated. It is difficult to electroplate at all in relatively long tubes of small diameter.

For efficient and reliable operation of these plunger-type contacts, it is necessary that one end of the plunger remain in good electrical contact with the interior of the tubular metal body of the contact. As discussed in the U.S. Pat. No. 3,435,168 this is accomplished by maintaining one end of the plunger firmly in contact with the electrically conductive metal plating on the inside of the metal tubular body. For good electrical contact, it is necessary that this plating layer be located on those portions of the interior of the tubular body which the end of the plunger slidably contacts, but it is unnecessary and wasteful of plating metal to have the interior of the tubular body totally plated. As the plating metal in these contacts is generally gold, it is clear that substantial economies would result, without adversely affecting the performance of the contacts, if the plating on the interior of the tubular body were restricted to those portions of the bore over which the end of the plunger-type contact slides. Selective plating of certain portions of a surface is known, masks being employed to isolate areas not to be plated. However, selectively plating certain interior surface areas of small diameter tubes is for practical purposes impossible since application and removal of appropriate resists is extremely difficult in such tubes. For this reason, plating is normally performed on a relatively accessible exposed surface.

In view of the savings in costs of manufacturing plunger-type electrical contacts which could be realized by gold plating only those portions of the tubular bore which contact the end of the plunger, it is be very desirable to have a process for producing a metal coating on selected portions of the inner surface of small diameter tubes.

SUMMARY OF THE INVENTION

The present invention provides an improved method for producing a small diameter metal tube for manufacturing the body of a plunger-type electrical contact, the tube having a coating of different metal on selected portions of its inner surface, resulting in substantial savings of plating material and expense relative to the prior art practice of coating the entire interior of such a small diameter tube. The invention can also be employed for selective coating of different metal on the outer surface of a tube.

A small diameter tube partially plated on selected portions of its interior is produced by coating a flat piece of a first metal with a predetermined pattern of a second metal, generally gold, on at least one preselected portion of the surface of the flat piece, and then deep drawing the flat piece to form a tube, the piece being oriented in the die employed in the deep drawing operation such that the coating of the second metal is on the inside of the resulting tubular structure, which ultimately possesses a coating of the second metal in a predetermined pattern in at least one preselected portion of its inner surface. The coated portion of the interior surface of the tube is less than the total inner surface of the tube. The pattern if the metal coating resulting on the interior of the deep drawn tube is a function of the pattern of the metal coating on the original piece of flat metal from which the tube is made.

DESCRIPTION OF THE DRAWING

This invention will be better understood in connection with the detailed description taken in conjunction with the drawing, in which.

DETAILED DESCRIPTION OF THE INVENTION

Figure 1:
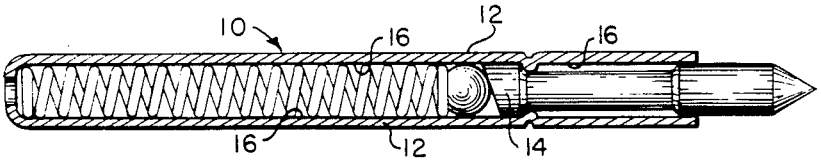
FIG. 1 is a cross-sectional view of a typical plunger-type electrical contact, showing the general arrangement of its operative parts.

Referring now to FIG. 1, there is shown a typical plunger-type electrical contact 10, with tubular metal body 12, plunger-type contact 14, and the interior coating of conductive metal 16. Interior metal coating 16 is generally gold.

Figure 2:
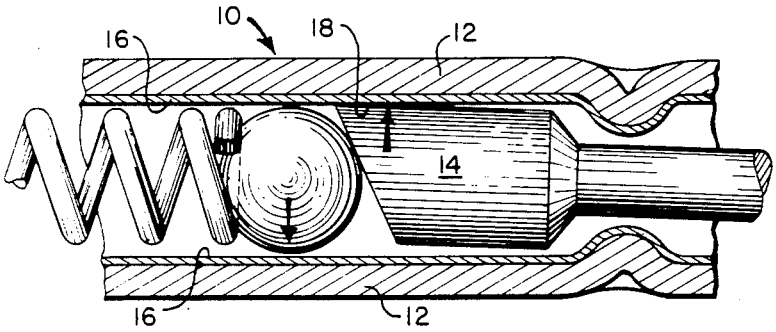
FIG. 2 is an enlarged cross-sectional view of a portion of the contact shown in FIG. 1, showing the slidable connection between the plunger end and the interior plating.

FIG. 2 shows an enlarged cross-sectional view of a portion of the contact shown in FIG. 1. In this figure, the area of contact, 18, between the end of plunger 14 and the interior gold coating 16 is clearly shown. This figure also illustrates that in the known plunger-type contacts, tubular metal body 12 is plated throughout its entire interior bore with gold coating 16. While the interior coating of conductive metal 16 is generally gold, any conductive and ductile metal which can be made to adhere to metal body 12 will serve.

In the present invention, plunger-type electrical contacts are produced in which the tubular metal body 12 is coated with a different metal on preselected portions of its inner surface, without coating the entire inner surface of the tube. In this improvement all the advantages of the known electrical contacts are retained, and in addition substantial savings of expensive plating material are achieved. Preselected portions of the interior surface of tubular metal body 12 are coated in a predetermined pattern with a second conductive metal 16 to provide a good electrical contact between plunger 14 and tubular body 12, but coating 16 is restricted to those areas of the inside surface of body 12 which come in contact with the end of plunger 14 as it slides in and out of body 12. The areas of the interior surface of body 12 which do not come in contact with plunger 14 are generally not metal plated. Furthermore, it is not necessary that the entire interior surface of body 12 which might possibly come in contact with plunger 14 be metal coated, provided that a sufficient portion of this surface is coated so that good electrical contact with plunger 14 is assured.

Figure 3:
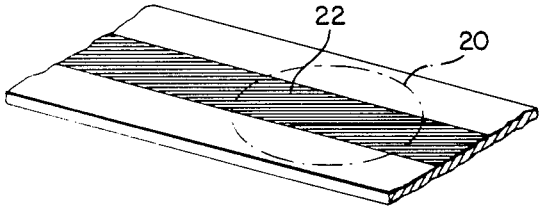
FIG. 3 shows a metal strip plated in striped pattern, from which circular discs plated in a striped pattern may be cut.
Figure 4:
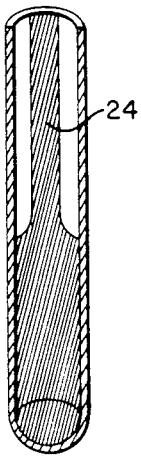
FIG. 4 is an enlarged full-sectional view of a tube resulting from the deep drawing of the disc of FIG. 3, showing the resulting longitudinal stripes of plating on the tube interior.
Figure 5:
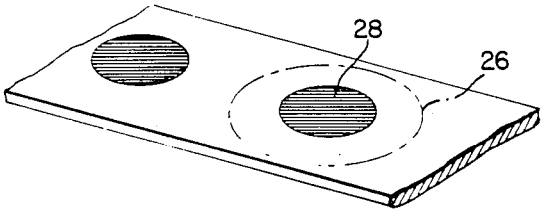
FIG. 5 shows a metal strip plated in a repeating spotted pattern, from which circular discs with a centrally plated spot may be cut.
Figure 6:
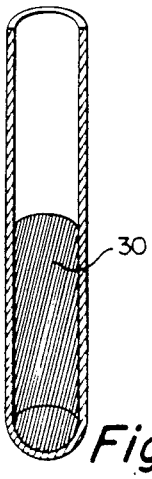
FIG. 6 is an enlarged full-sectional view of the tube resulting from deep drawing of the disc of FIG. 5, and the resulting interior plating at one end.
Figure 7:
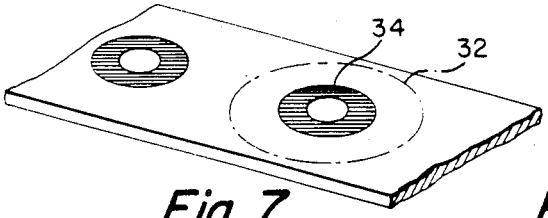
FIG. 7 shows a metal strip plated in a repeating donut pattern, from which circular discs centrally plated with a donut-shaped pattern may be cut.
Figure 8:
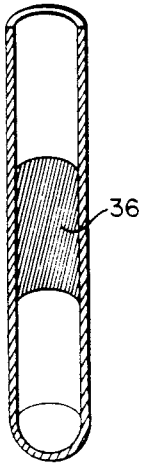
FIG. 8 is an enlarged full-sectional view of the tube resulting from deep drawing of the disc of FIG. 7, including the plated band resulting from the original donut.

A plunger-type electrical contact having a tubular metal body coated on preselected portions of its interior surface with a predetermined pattern of a second conductive metal is produced according to the invention by applying a deep drawing process to a flat metal piece coated with a layer of the desired second metal, generally gold, in a predetermined pattern such as those shown on the discs of FIGS. 3, 5, and 7. In the deep drawing process, the starting sheet metal is first forced into a cup-shaped die by an appropriately shaped piston, and then this process is repeated using dies which are successively narrower and deeper, until ultimately a tube of very small diameter is formed. This tube may possess a closed end, or a ragged open end if the piston breaks through during the deep drawing operation. In the latter instance the ragged edge is trimmed off; in the former instances the closed end may be removed if desired. The result is a tube having on a preselected portion of its interior surface a predetermined pattern of the metal coating. For example, if a circular metal disc 20 is coated on one side with a stripe 22 of gold across its diameter, as shown in FIG. 3, deep drawing will produce a tube having a gold stripe 24 on opposite sides of its interior along at least a portion of the length of the tube, as shown in FIG. 4. Similarly, if a circular metal disc 26 is coated at its center with a round spot 28 of gold, as shown in FIG. 5, deep drawing will produce a tube having gold plating 30 covering the interior of one end, as shown in FIG. 6, the length of tube interior which is so covered being a function of the diameter of the original gold spot. As another example, if a circular metal disc 32 carries a donut-shaped coating 34 of gold around its center, as shown in FIG. 7, deep drawing will produce a tube having a circumferential band 36 of gold around its interior, as shown in FIG. 8, at some distance from one end of the tube. The location of this band will be a function of the diameter of the original ring of gold, and the width of the resulting gold band will be a function of the width of the original donut. The tube thus formed is used to make the body of an electrical contact as disclosed in U.S. Pat. No. 3,435,168, with the difference that in the electrical contacts made according to the present invention, the body of the electrical contact is coated only on preselected portions of its interior surface, corresponding to those areas which come into sliding contact with the end of the contact plunger.

Although the invention has been disclosed in terms of specific examples and drawings, it is not to be limited except by the scope of the appended claims.

What is claimed is:

1. A method for producing a metal tube from which the body of a plunger-type electrical contact is to be made, said tube having a coating of a different metal on selected portions of its inner surface, the method comprising:

coating a flat piece of a first metal, from which said tube is to be made, with a predetermined pattern of a second metal on at least one preselected portion of the surface of said flat piece, said portion being less than the total surface of said flat piece and corresponding ultimately to the portion of the interior of the electrical contact body which comes into sliding contact with the end of the contact plunger; and deep drawing said flat piece to form a tube, said piece being oriented in the die employed in said deep drawing operation such that said second metal coating is on the inside of the resulting tubular structure;

whereby a tube possessing a coating of said second metal in a predetermined pattern on at least one preselected portion of its inner surface is formed.

2. The method of claim 1 wherein said flat piece is a round disc.

3. The method of claim 2 wherein said second metal is coated on said disc as a band running diametrically across the disc.

4. The method of claim 2 wherein said second metal is coated on said disc as a round spot located at the center of said disc.

5. The method of claim 2 wherein said second metal is coated on said disc as a donut-shaped band located concentrically around the center of said disc.

6. The method of claim 1 wherein said second metal is gold.

* * * * *